US009905178B2

(12) United States Patent
Harada

(10) Patent No.: US 9,905,178 B2
(45) Date of Patent: Feb. 27, 2018

(54) LIQUID CRYSTAL DISPLAY APPARATUS AND METHOD OF DRIVING THEREOF

(71) Applicant: Japan Display Inc., Minato-ku (JP)

(72) Inventor: Kenji Harada, Tokyo (JP)

(73) Assignee: Japan Display Inc., Minato-ku (JP)

( * ) Notice: Subject to any disclaimer, the term of this patent is extended or adjusted under 35 U.S.C. 154(b) by 35 days.

(21) Appl. No.: 14/190,279

(22) Filed: Feb. 26, 2014

(65) Prior Publication Data

US 2014/0240374 A1 Aug. 28, 2014

(30) Foreign Application Priority Data

Feb. 28, 2013 (JP) ..... 2013-038819

(51) Int. Cl.
*G09G 5/00* (2006.01)
*G09G 3/36* (2006.01)

(52) U.S. Cl.
CPC ... *G09G 3/3655* (2013.01); *G09G 2300/0426* (2013.01); *G09G 2320/0233* (2013.01)

(58) Field of Classification Search
CPC ..... G09G 3/3655; G09G 2320/0233; G09G 3/3607; G09G 3/3696; G09G 2300/0426; G09G 2300/0876
USPC ..... 345/90, 211, 690
See application file for complete search history.

(56) References Cited

U.S. PATENT DOCUMENTS

| | | | | |
|---|---|---|---|---|
| 7,800,579 | B2 * | 9/2010 | Lee et al. | 345/103 |
| 7,952,547 | B2 * | 5/2011 | Wei | 345/87 |
| 8,717,265 | B2 * | 5/2014 | Lee | G09G 3/3614 345/103 |
| 2002/0063703 | A1 * | 5/2002 | Furuhashi et al. | 345/212 |
| 2007/0030231 | A1 * | 2/2007 | Lee | G09G 3/3655 345/94 |
| 2012/0098816 | A1 * | 4/2012 | Lee et al. | 345/212 |
| 2013/0328755 | A1 * | 12/2013 | Al-Dahle | G09G 3/3655 345/87 |

FOREIGN PATENT DOCUMENTS

| | | |
|---|---|---|
| JP | 2009-244958 | 10/2009 |
| JP | 2009-296252 | 12/2009 |

* cited by examiner

*Primary Examiner* — Amr Awad
*Assistant Examiner* — Aaron Midkiff
(74) *Attorney, Agent, or Firm* — Oblon, McClelland, Maier & Neustadt, L.L.P.

(57) ABSTRACT

A row common electrode drive circuit and a column common electrode drive circuit control an effective value of a voltage to be applied to common electrodes along rows in which pixels are arrayed and an effective value of a voltage to be applied to the common electrodes along columns in which the pixels are arrayed.

6 Claims, 8 Drawing Sheets

LIQUID CRYSTAL DISPLAY APPARATUS AND METHOD OF DRIVING THEREOF

CROSS-REFERENCE TO RELATED APPLICATIONS

This application is based upon and claims the benefit of priority from the prior Japanese Patent Application No. 2013-38819, filed on Feb. 28, 2013; the entire contents of which are incorporated herein by reference.

FIELD

The embodiment disclosed here relates to a liquid crystal display apparatus and a method of driving thereof.

BACKGROUND

An active matrix type liquid crystal display apparatus includes a pair of substrates opposing each other, a liquid crystal layer sandwiched between the pair of the substrates, and a display unit including a plurality of pixels arranged in a matrix pattern. One of the pair of the substrates includes scanning lines arranged along arrays of a plurality of pixel rows and signal lines arranged along arrays of a plurality of pixel columns in the display unit . The oriented state of liquid crystal molecules included in the liquid crystal layer is controlled by an electric field applied to the liquid crystal layer (JP-A-2009-296252 (KOKAI)).

Among others, liquid crystal display apparatuses of IPS (In-Plane Switching) system and FFS (Fringe Field Switching) system include a plurality of pixel electrodes arranged on one of the pair of the substrates in the matrix pattern and common electrodes opposing the plurality of the pixel electrodes, and are configured to control the oriented state of the liquid crystal molecules included in the liquid crystal layer by a lateral electric field generated between the pixel electrodes and the common electrodes. These liquid crystal display apparatuses have superior characteristics such as a wide view angle or low power consumption, and are widely applied to displays for TVs and mobile phones.

In recent years, there is an increasing demand for a user interface provided on a display surface such as a touch panel for improving operability, and products provided with a contact detecting element on the display surface of the liquid crystal apparatus are spreading in the market. For example, according to JP-A-2009-296252 (KOKAI), the contact detecting element and the liquid crystal display apparatus may be integrated, so that the liquid crystal display apparatus provided with a contact detecting function is provided at low costs.

In the above-described liquid crystal display apparatus, the orientation of the liquid crystal molecules included in the liquid crystal layer is controlled by voltages to be supplied to the common electrodes and video signals to be written in the pixel electrodes in sequence. In the configuration disclosed in JP-A-2009-296252 (KOKAI), the common electrodes also serve as wiring for detecting a change of electrostatic capacity caused by a contact on the display surface, and a plurality of the common electrodes are disposed electrically independently in the display surface.

The liquid crystal display apparatus and the method of driving the same of the related art will be described in detail below with reference to FIG. 5 to FIG. 8, and the problems will be clarified. The liquid crystal display apparatus here is assumed to be normally black and of the FFS system.

(1) Structure of Liquid Crystal Display Apparatus of Related Art

The structure of the liquid crystal display apparatus of the related art will be described with reference to FIG. 5.

As illustrated in FIG. 5, the liquid crystal display apparatus of the related art includes a pair of an array substrate (which is not illustrated) and a counter substrate (which is not illustrated) opposing each other, a liquid crystal layer LQ sandwiched between the array substrate and the counter substrate, and a display unit (which is not illustrated) including pixels PX arranged in the matrix pattern.

The array substrate is formed of a transparent insulative substrate (which is not illustrated), and pixel electrodes PE arranged on the respective pixels PX, scanning lines GL (GL1, GL2, GL3, . . . ) extending along the rows of the pixel electrodes PE, a scanning line drive circuit GD, signal lines SL (SL1, SL2, SL3, . . . ) extending along the columns of pixel electrodes PE, pixel switches SWP arranged at positions in the vicinity of points of intersection of the scanning lines GL and the signal lines SL, and common electrodes COM arranged so as to oppose the plurality of the pixel electrodes PE via the pixel electrodes PE and the insulating layer (which is not illustrated) on the transparent insulative substrate. The common electrode COM includes column common electrodes arranged along the columns of the pixel electrodes PE (hereinafter referred to as "column common electrode") COM_Column and row common electrodes COM_Row arranged along the rows of the pixel electrodes PE (hereinafter referred to as "row common electrode").

The pixel switch SWP includes a TFT (Thin Film Transistor) as a switching element. A gate electrode of the TFT is electrically connected to or integrated with the corresponding scanning line GL. A source electrode of the TFT is electrically connected to or integrated with the corresponding signal line SL. A drain electrode of the TFT is electrically connected to or integrated with the corresponding pixel electrode PE.

When an ON voltage is applied to the gate electrode of the TFT, electricity is conducted between the source electrode and the drain electrode, and a video signal is supplied from the corresponding signal line SL to the pixel electrode PE. A liquid crystal capacity is formed by the video signal applied to the pixel electrode PE, and a common voltage applied to the common electrodes COM_(COM_Column, COM_Row).

The pixel electrodes PE includes, for example, slits at a predetermined interval, and a lateral electric field is generated between the pixel electrode PE and the common electrodes COM_(COM_Column, COM_Row) arranged via an insulating layer. The oriented state of the liquid crystal molecules included in the liquid crystal layer LQ is controlled by the lateral electric field. Each pixel PX further includes an auxiliary capacity CS configured to be coupled with the liquid crystal capacity. The liquid crystal capacity is accumulated in the liquid crystal layer by the electric field applied to the liquid crystal layer. The auxiliary capacity CS is a capacity generated between the pixel electrode PE and the common electrodes COM_(COM_Column, COM_Row).

The common electrodes COM_(COM_Column, COM_Row) are wiring of the plurality of the common electrodes which are electrically independent, and also serve as wiring for detecting a change in an electrostatic capacity caused by the contact on the display surface.

In a display period, a common voltage is commonly supplied to each of the plurality of common electrodes COM (COM_Column, COM_Row). In a period in which the contact on the display surface is to be detected, independent detecting signals are supplied to the common electrodes COM (COM1, COM2, COM3, . . . ) respectively.

In one frame, rewriting of the liquid crystal display is performed in the same manner as the normal liquid crystal display apparatus in sequence on the basis of row scanning, and the detection of the contact on the display surface is performed during a vertical blanking period, so that the display of the liquid crystal and the detection of the contact on the display surface are both achieved. The detection of the contact on the display surface is performed on the basis of the detection signals as described in JP-A-2009-296252 (KOKAI).

During the display period, a common voltage common to the column common electrode COM_Column and the row common electrodes COM_Row, is supplied thereto by a common electrode drive circuit COM_Dry. The common electrode drive circuit COM_Dry includes a buffer circuit 1 and an amplitude control circuit 2. A high potential and a low potential of the common voltage are determined by the amplitude control circuit 2, and the buffer circuit 1 amplifies a current and supplies the same to the common electrodes COM_(COM_Column, COM_Row) after an adequate amplitude A has been set.

A switching element DEMUX_SW includes a demultiplexer, is turned ON in sequence during one horizontal period, and supplies the video signals output from one output terminal of a signal line drive circuit (which is not illustrated) divided temporarily into three signal lines (SL1, SL2, and SL3) to the same. The video signals supplied to each of the signal lines are supplied to the pixel electrode PE via a pixel switch SWP.

(2) Method of Driving Liquid Crystal Display Apparatus of Related Art

A method of driving the liquid crystal display apparatus of the related art will be described. In order to simplify the description of the problems of the related art, the driving method will be described in FIG. 7 with reference to FIG. 6, which illustrates a configuration of FIG. 5 simplified with a smaller number of pixels.

As illustrated in FIG. 6, the simplified liquid crystal display apparatus includes six scanning lines GL1, GL2, . . . GL6, and includes a column common electrode COM_Column, a row common electrode COM_Row1, a row common electrode COM_Row2, and a row common electrode COM_Row3 having the arrayed pixel electrodes PE as a plurality of the common electrodes COM.

As illustrated in FIG. 7, the gate signal output from the scanning line drive circuit GD is supplied to the scanning lines GL1, GL2, . . . GL6 to be driven in sequence by one horizontal period.

An AC driving of the liquid crystal is achieved by the signal line drive circuit (which is not illustrated) switching the polarity of the potential of the video signal to be charged to the pixel electrodes PE to positive and negative alternately for the common voltage from one frame to another.

When the potential of the video signal in the signal lines varies, in particular, when the video signal is charged by temporarily dividing the one horizontal period by a demultiplexer DEMUX_SW, a charging and discharging current is generated in the pixel electrodes PE of the selected scanning line, and hence the potential variation of the common electrode COM_occurs due to the capacity coupling.

However, the common electrodes COM_(COM_Row1, COM_Row2, COM_Row3, COM_Column) are provided as electrically independent wiring in the display surface as wiring for detecting the change of the electric static capacity caused by the contact on the display surface as described above, and hence have different and specific time constants, and the potential is converged independently according to the respective time constants.

Since the common electrodes COM_(COM_Row1, COM_Row2, COM_Row3, COM_Column) divide the display area in a plane, the potential variations thereof behave in conjunction with the scanning line included in the corresponding areas.

For example, the row common electrode COM_Row1 includes the scanning lines GL1 and GL2 in an area 3 and an area 5. Therefore, as illustrated in FIG. 7, between a period 1 (this period is one horizontal period) and a period 2, the gate signals GL1 and GL2 are input in addition to the coupling between the signal line and the common electrode COM, and hence direct transmission of electric charge with respect to the pixel electrodes PE occurs. Therefore, the potential of the row common electrode COM_Row1 notably varies. However, in other periods 3 to 6, the potential variation of the row common electrode COM_Row1 is caused only by the coupling between the signal line and the common electrode COM, and hence the potential variation is calm.

In the same manner, since the row common electrode COM_Row2 includes the scanning liens GL3 and GL4 in an area 6 and an area 8 between the period 3 and the period 4, direct transmission of the electric charge with respect to the pixel electrodes PE occurs in addition to the coupling between the signal line and the common electrode COM. Therefore, the potential of the row common electrode COM_ Row2 notably varies. However, in other periods 1, 2, 5, and 6, the potential variation thereof is caused only by the coupling between the signal line and the common electrode COM, and hence the potential variation is calm.

In the same manner, since the row common electrode COM__Row3 includes the scanning liens GL5 and GL6 in an area 9 and an area 11 between the period 5 and the period 6, direct transmission of the electric charge with respect to the pixel electrodes PE occurs in addition to the coupling between the signal lien and the common electrode COM. Therefore, the potential of the row common electrode COM_ Row3 notably varies. However, in other periods 1 to 4, the potential variation of the row common electrode COM_ Row3 is caused only by the coupling between the signal line and the common electrode, and hence the potential variation is calm.

In contrast, since the column common electrode COM_ Column includes all the scanning liens GL1, GL2, GL3, GL4, GL5, and GL6 in the area 4, the area 7, and the area 10 in the period 1 to the period 6, direct transmission of the electric charge with respect to the pixel electrodes PE occurs in addition to the coupling between the signal line and the common electrode COM, so that the potential of the column common electrode COM_Column varies notably and continuously.

(3) Problem of Related Art

As is clear from the description given above, an effective value of the voltage of the column common electrode COM_Column is smaller than effective values of the row common electrode COM_Row1, COM_Row2, and COM_ Row3. Since the liquid crystal responds to the effective value of the AC electric field, the luminance of the pixels belonging to the areas of the column common electrode COM_Column is low.

In other words, as illustrated in FIG. 8, the area 4, the area 7, and the area 10 which belong to the column common electrode COM_Column are darker than other areas, and the display unevenness along the wiring of the column common electrode COM_Column occurs. In FIG. 8, the difference in luminance is indicated by a diagonal hatch and a cross hatch marked in the respective areas.

Although charging of the common electrodes in the display periods have been focused in the description here, the difference in effective value occurs from one display area to another even in a case where independent signals for inspection are applied to the column common electrode COM_Column and the row common electrodes COM_Row respectively in the vertical blanking period.

Accordingly, in view of such problems described above, it is an object of the invention to provide a liquid crystal display apparatus which prevents occurrence of display unevenness is avoided and achieves a desirable quality, and a method of driving the same.

DETAILED DESCRIPTION

Figure 1:
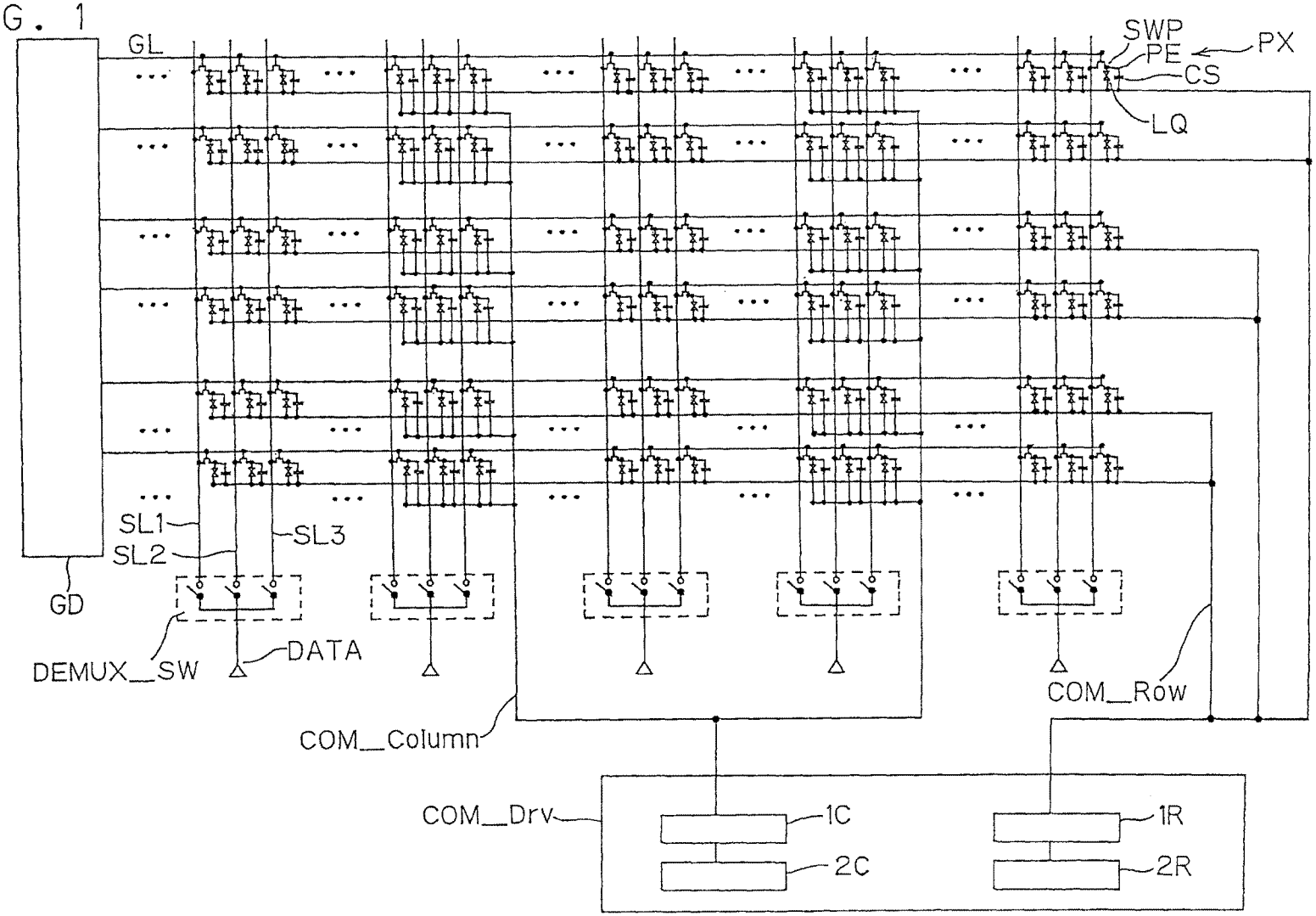
FIG. 1 is a drawing for explaining a liquid crystal display apparatus according to an embodiment.

According to embodiments, there is provided a liquid crystal display apparatus including: a plurality of pixels arranged on a substrate in a matrix pattern; pixel electrodes arranged on the respective pixels; pixel switches arranged on the respective pixels; scanning lines extending along rows in which the plurality of pixels are arrayed; signal lines extending along columns in which the plurality of pixels are arrayed; a scanning line drive circuit configured to supply gate signals to the scanning lines; a signal line drive circuit configured to supply video signals to the signal lines; a plurality of common electrodes arranged in a display plane electrically independently via the pixel electrodes of the plurality of pixels arranged in a direction of the row and an insulating layer; a row common electrode drive circuit configured to supply a voltage to the common electrodes along the rows in which the pixels are arrayed; and a column common electrode drive circuit configured to supply a voltage to the common electrodes along the column in which the pixels are arrayed, wherein the scanning line drive circuit drives the pixel switches of the respective pixels by the gate signals to be supplied to the scanning lines, connects the signal lines and the pixel electrodes, and supplies the video signals to the respective pixels, and the row common electrode drive circuit and the column common electrode drive circuit control an effective value of a voltage to be applied to the common electrodes along the rows in which the pixels are arrayed and an effective value of a voltage to be applied to the common electrodes along the columns in which the pixels are arrayed.

According to the embodiment, there is provided a method of driving a liquid crystal display apparatus, the liquid crystal display apparatus including: a plurality of pixels arranged on a substrate in a matrix pattern; pixel electrodes arranged on the respective pixels; pixel switches arranged on the respective pixels; scanning lines extending along rows in which the plurality of pixels are arrayed; signal lines extending along columns in which the plurality of pixels are arrayed; a scanning line drive circuit configured to supply gate signals to the scanning lines; a signal line drive circuit configured to supply video signals to the signal lines; and a plurality of common electrodes arranged in a display plane electrically independently via the pixel electrodes of the plurality of pixels arranged in a direction of the row and an insulating layer, including driving the pixel switches of the respective pixels by the gate signals to be supplied to the scanning lines, connecting the signal lines and the pixel electrodes, and supplying the video signals to the respective pixels, and controlling an effective value of a voltage to be applied to the common electrodes along the rows in which the pixels are arrayed and an effective value of a voltage to be applied to the common electrodes along the columns in which the pixels are arrayed.

Referring now to the drawings, the liquid crystal display apparatus according to an embodiment and the method of driving the same will be described.

The liquid crystal display apparatus of the embodiment is also normally black and of the FFS system in the same manner as the related art. A different point of the liquid crystal display apparatus of the embodiment from the liquid crystal display apparatus of the related art is a common electrode drive circuit COM_Dry and an action thereof. Therefore, the same portions as in the related art are denoted by the same reference numerals and detailed description is omitted.

(1) Structure of Liquid Crystal Apparatus

The common electrode drive circuit COM_Dry of the liquid crystal display apparatus of the embodiment will be described with reference to FIG. 1.

As illustrated in FIG. 1, the common electrode drive circuit COM_Dry includes a buffer circuit 1R, an amplitude control circuit 2R, a buffer circuit 1C and an amplitude control circuit 2C.

The buffer circuit 1R supplies a voltage to the common electrodes (hereinafter, referred to as "row common electrode") COM_Row arranged along rows of the pixel electrodes. The amplitude control circuit 2R determines the amplitude of the voltage that the buffer circuit 1R supplies. The buffer circuit 1R and the amplitude control circuit 2R constitute a row common electrode drive circuit.

The buffer circuit 1C supplies a voltage to the common electrodes (hereinafter, referred to as "column common electrode") COM_Column arranged along the columns of the pixel electrodes. The amplitude control circuit 2C determines the amplitude of the voltage that the buffer circuit 1C supplies. The buffer circuit 1C and the amplitude control circuit 2C constitute a column common electrode drive circuit.

During the display period, common voltages COM_set individually by the independent buffer circuit 1R, the amplitude control circuit 2R, the buffer circuit 1C and the amplitude control circuit 2C are supplied to the column common electrode COM_Column and the row common electrodes COM_Row.

In other words, the amplitude control circuit 2R determines a high potential and a low potential for determining the amplitude of the voltage to be applied to the row common electrodes COM_Row, and sets an adequate amplitude A, then the buffer circuit 1R amplifies the current and supplies the same to the row common electrodes COM_Row.

Also, the amplitude control circuit 2C determines the high potential and the low potential for determining the amplitude of the voltage to be applied to the column common electrodes COM_Column, and sets an adequate amplitude B, then the buffer circuit 1C amplifies the current and supplies the same to the column common electrodes COM_Column.

(2) Method of Driving Liquid Crystal Display Apparatus of Embodiment

Subsequently, the method of driving the liquid crystal display apparatus of the embodiment will be described. In order to simplify the description, driving timing will be described in FIG. 3 with reference to FIG. 2, which illustrates a configuration of FIG. 1 simplified with a smaller number of the pixels.

Figure 2:
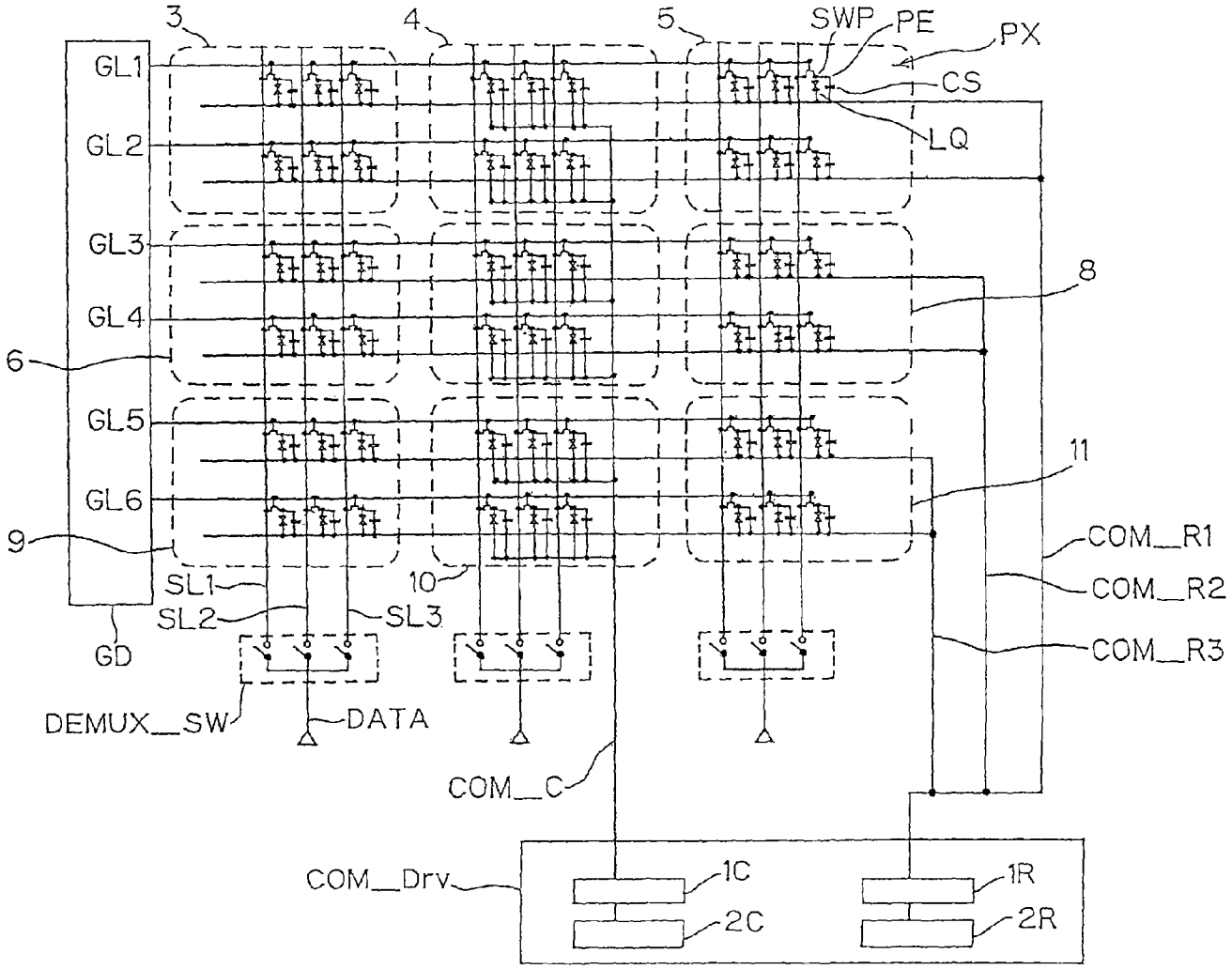
FIG. 2 is a drawing for explaining the liquid crystal display apparatus according to the embodiment.
Figure 3:
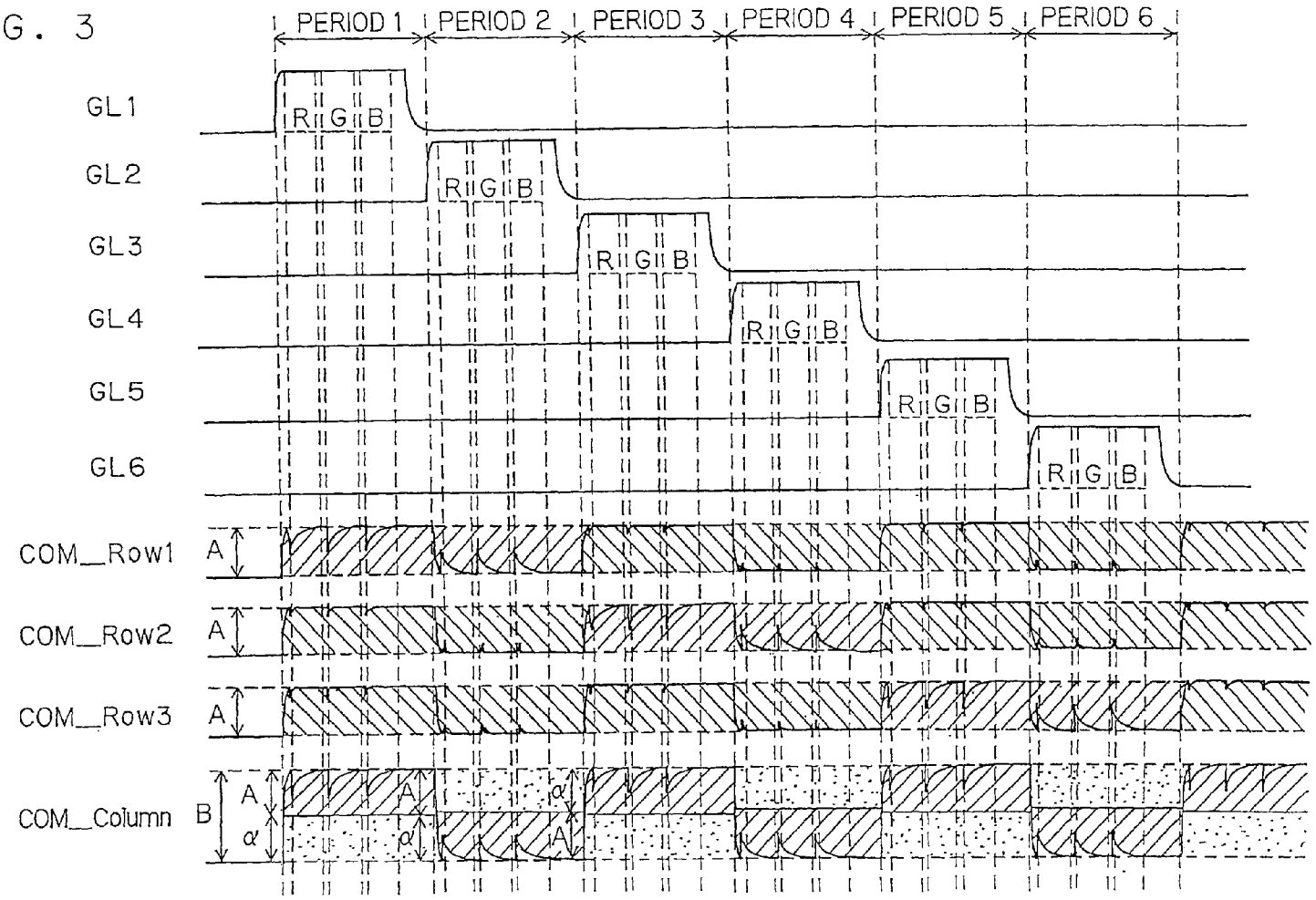
FIG. 3 is a timing chart for explaining an example of a method of driving the liquid crystal display apparatus of the embodiment.

As illustrated in FIG. 2, the simplified liquid crystal display apparatus includes six scanning lines GL1, GL2, . GL6, and a plurality of common electrodes COM, and the common electrode COM_includes a column common electrode COM_Column, a row common electrode COM_ROW1, a row common electrode COM_Row2, and a row common electrode COM_Row3 as the plurality the common electrodes COM.

In the embodiment, when the potential of the video signal in the signal lines varies, in particular, when the video signal is charged by temporarily dividing the one horizontal period by the demultiplexer, a charging and discharging current is generated in the pixel electrodes PE of the selected scanning line, and hence the potential variation of the common electrode COM_occurs due to the capacity coupling, which is the same as in the related art.

In the embodiment, the common electrodes COM_ (COM_ Row1, COM_Row2, COM_Row3, and common electrode COM_Column) have specific time constants different from each other, the potentials are converged independently in accordance with the respective time constants, and the potential variations thereof behave in conjunction with the scanning line included in the corresponding areas in the same manner as the related art.

As described in the related art, in the common amplitude, an effective value of the voltage of the column common electrode COM_Column is smaller than effective values of the voltage of the row common electrodes COM_ROW1, COM_Row2, and COM_Row3, and the difference in effective value is generated.

Accordingly, in the driving method of the embodiment, the difference of the elective values is compensated in order to equalize the effective values of the respective voltages of the the row common electrodes COM_Row1, COM_Row2, and COM_Row3 and the effective value of the column common electrode COM_Column. More specifically, the amplitude control circuit 2C sets the amplitude of the voltage to be applied to the column common electrode COM_Column to B=A+a, and the smaller effective value of the voltage of the column common electrode COM_Column is inflated. The value of a is determined in advance by experiment or the like and is set to the amplitude control circuit 2C.

(3) Advantages

According to the embodiment, as is clear from the description given above, the effective value of the voltage of the column common electrode COM_Column is the same as the effective values of the row common electrodes COM_ROW1, COM_Row2, and COM_Row3. Since the liquid crystal responds to the effective value of the applied AC electric field, such a phenomenon that the luminance of the pixels belonging to an area of the column common electrode COM_Column is lowered as in the related art may be suppressed.

Figure 4:
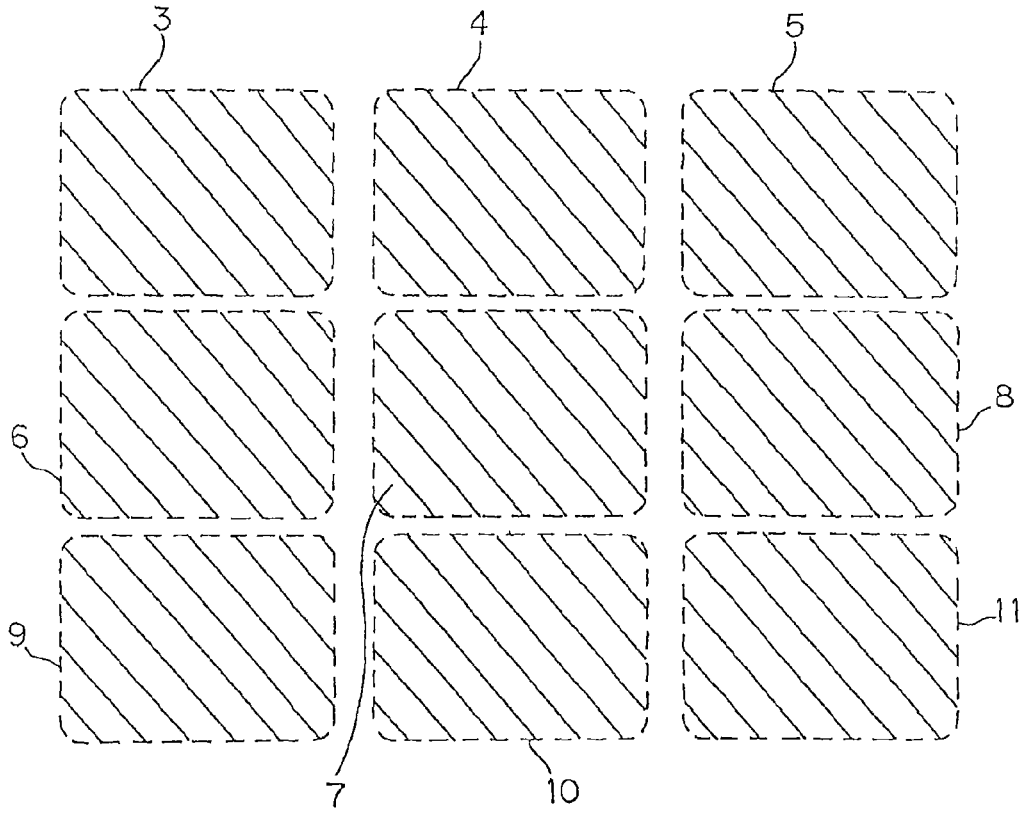
FIG. 4 is a drawing for explaining advantages of the liquid crystal display apparatus according to the embodiment.
Figure 5:
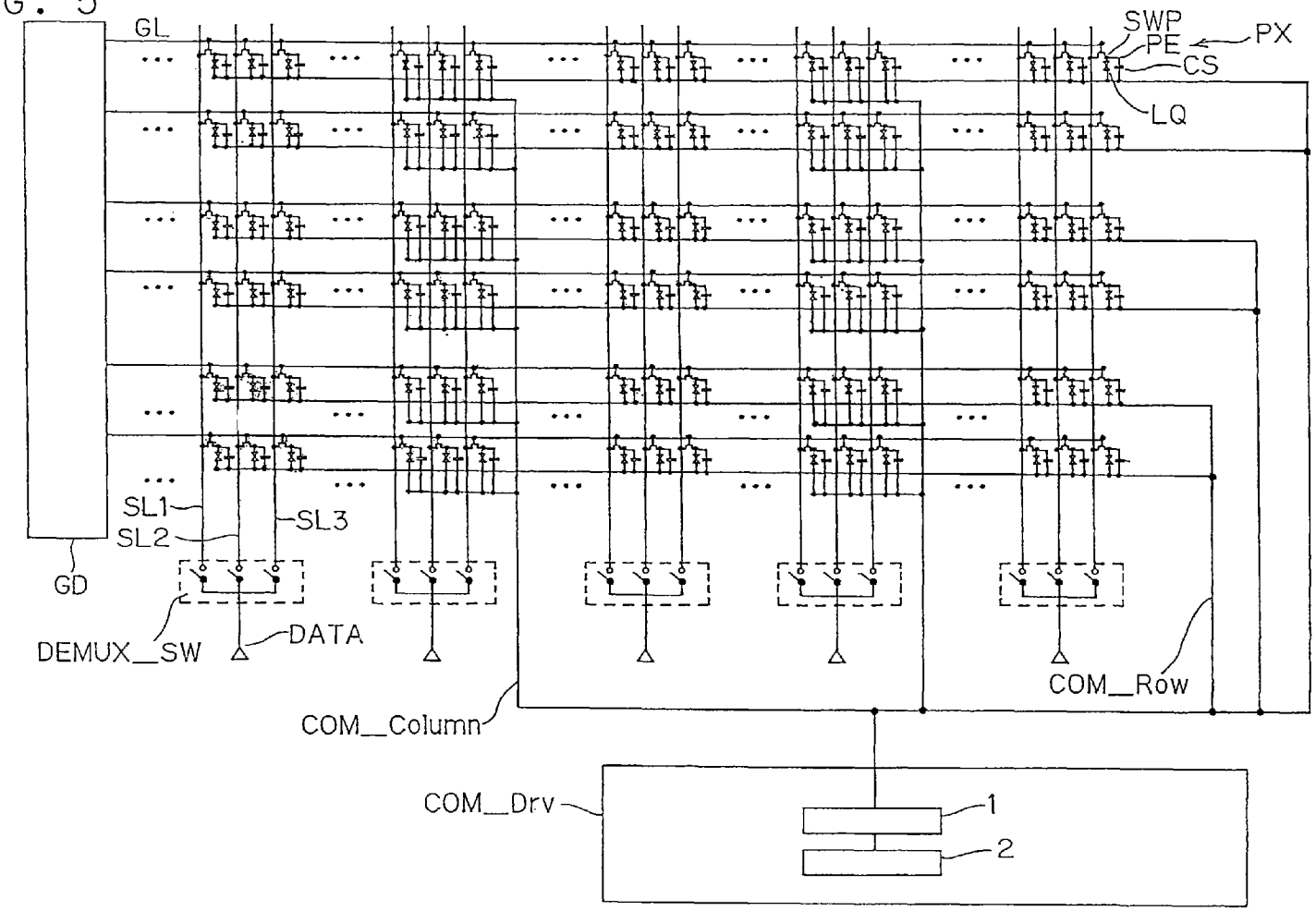
BACKGROUND ART FIG. 5
FIG. 5 is a drawing for explaining a liquid crystal display apparatus of the related art.
Figure 6:
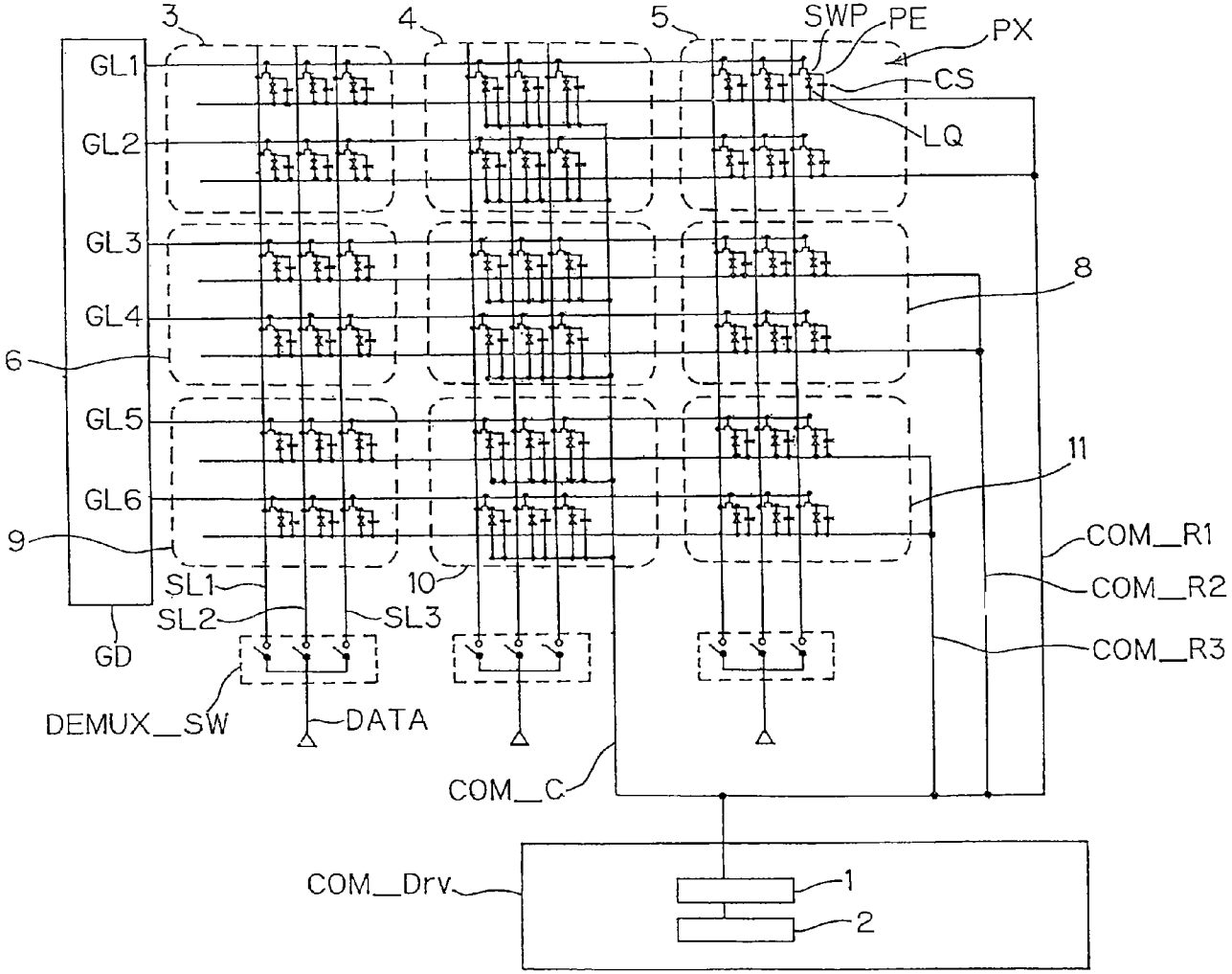
BACKGROUND ART FIG. 6
FIG. 6 is a drawing for explaining the liquid crystal display apparatus of the related art.
Figure 7:
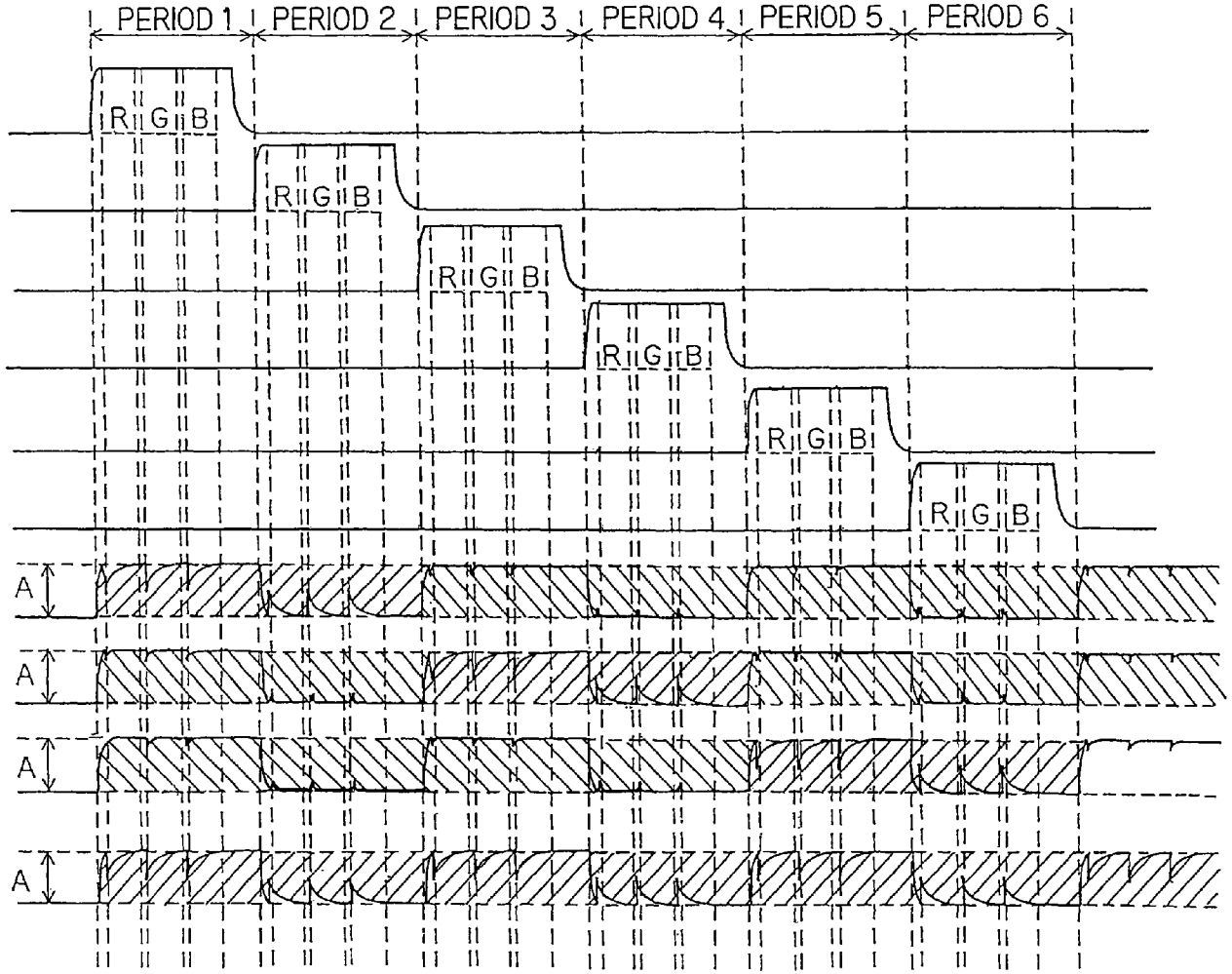
BACKGROUND ART FIG. 7
FIG. 7 is a timing chart for explaining an example of a method of driving the liquid crystal display apparatus of the related art.
Figure 8:
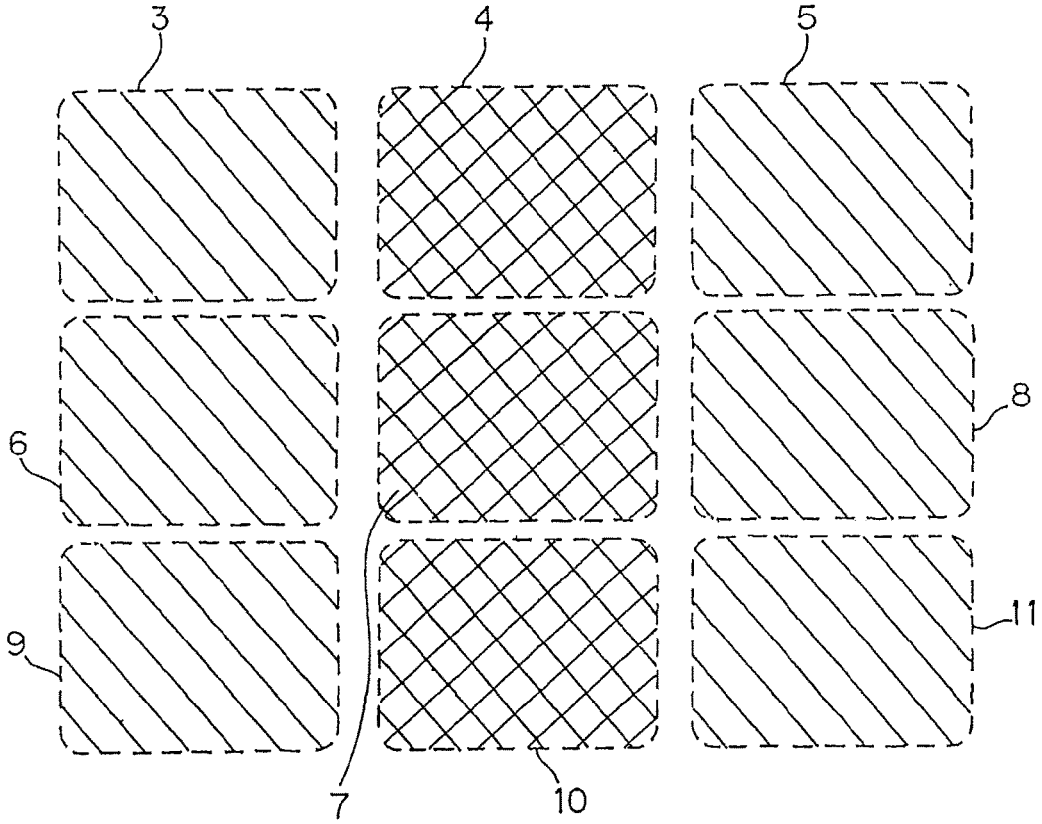
FIG. 8 BACKGROUND ART
FIG. 8 is a drawing for explaining problems of the liquid crystal display apparatus of the related art.

In other words, as illustrated in FIG. 4, the same luminance as other areas is obtained even in the area 4, the area 7, and the area 10 which belong to the column common electrode COM_Column, the display unevenness along the wiring of the column common electrode COM_Column is avoided, and the liquid crystal display apparatus with a desirable quality is achieved. FIG. 4 illustrates the luminance of the respective areas with a diagonal hatch.

(4) Modification

In the embodiment, although charging of the common electrodes in the display periods have been focused in the description here, display unevenness is avoided and a liquid crystal apparatus having a good quality is achieved by correcting and adjusting the difference of the effective values occurring from one display area to another by the same method as described above so as to obtain an uniform effective value in the plane also in the case where independent signals for inspection are applied to the column common electrode COM_Column and the row common electrodes COM_ROW respectively in the vertical blanking period.

In the embodiment described above, the FFS type liquid crystal display apparatus has been described. Instead, however, the same advantages may be achieved by applying the embodiment as long as the liquid crystal display apparatus is a liquid crystal display apparatus employing DC for the common voltage and configured to invert the polarity of the potential to be applied to the liquid crystal layer LQ by changing the potential of the pixel electrodes PE from frame to frame.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid crystal display apparatus comprising:

a plurality of pixels arranged on a substrate in a matrix pattern;

pixel electrodes arranged on the respective pixels;

pixel switches arranged on the respective pixels;

scanning lines extending in a row direction in which the plurality of pixels are arrayed;

signal lines extending in a column direction in which the plurality of pixels are arrayed;

a scanning line drive circuit configured to supply gate signals to the scanning lines;

a signal line drive circuit configured to supply video signals to the signal lines;

row common electrodes extending in the row direction;

column common electrodes extending in the column direction;

a row common electrode drive circuit configured to supply a voltage to the row common electrodes;

a column common electrode drive circuit configured to supply a voltage to the column common electrodes;

the row common electrodes and the column common electrodes are used to detect a change in an electrostatic capacity caused by a contact on a display surface;

the row common electrodes are arranged to be electrically independent from the column common electrodes, and are not connected to the column common electrodes, the row common electrode drive circuit and the column common electrode drive circuit each have an amplitude control circuit configured to determine a high potential and a low potential for determining an amplitude;

each of voltages to be applied to the column common electrodes and the row common electrodes varies in potential in conjunction with the scanning lines;

the amplitude control circuit adjusts a second amplitude of the voltage applied from the column common electrode drive circuit to be higher than a first amplitude of the voltage applied from the row common electrode drive circuit because the column common electrodes vary in potential in conjunction with the scanning lines which are different from each other by a period; and the second amplitude with a potential variation become same as the first amplitude with a potential variation.

2. The liquid crystal display apparatus according to claim 1, wherein effective voltages in one horizontal period are adjusted to be equal among the row and column common electrodes.

3. The liquid crystal display apparatus according to claim 1, wherein red pixels, green pixels, and blue pixels are included as the pixels, and supplying of the video signals is switched in sequence within one horizontal period among supplying to the signal lines for the red pixels, supplying to the signal lines for the green pixels and supplying to the signal lines for the blue pixels, on the basis of time division in the one horizontal period.

4. The liquid crystal display apparatus according to claim 1, wherein the row common electrode drive circuit includes a row buffer circuit configured to supply the voltage to the row common electrodes, and the column common electrode drive circuit includes a column buffer circuit configured to supply the voltage to the column common electrodes.

5. The liquid crystal display apparatus according to claim 1, wherein the second amplitude of the voltage is set to be higher than the first amplitude of the voltage.

6. A method of driving a liquid crystal display apparatus, the liquid crystal display apparatus including:

a plurality of pixels arranged on a substrate in a matrix pattern;

pixel electrodes arranged on the respective pixels;

pixel switches arranged on the respective pixels;

scanning lines extending in a row direction in which the plurality of pixels are arrayed;

signal lines extending in a column direction in which the plurality of pixels are arrayed;

a scanning line drive circuit configured to supply gate signals to the scanning lines;

a signal line drive circuit configured to supply video signals to the signal lines;

row common electrodes extending in the row direction;

column common electrodes extending in the column direction;

an amplitude control circuit configured to determine a high potential and a low potential for determining an amplitude the method comprising:

varying in potential each of voltages to be applied to the column common electrodes and the row common electrodes in conjunction with the scanning lines; and adjusting a second amplitude of the voltage to be applied to the column common electrodes to be higher than a first amplitude of a voltage to be applied to the row common electrodes so that the second amplitude with a potential variation becomes substantially same as the first amplitude with a potential variation because the column common electrodes vary in potential in conjunction with the scanning lines which are different from each other by a period.

* * * * *